US011763621B2

(12) United States Patent
Varini

(10) Patent No.: US 11,763,621 B2
(45) Date of Patent: Sep. 19, 2023

(54) SYSTEM FOR CONTROLLING THE DISPENSING OF FUEL OR THE LIKE IN A VENDING APPARATUS, PARTICULARLY FOR PRIVATE USE

(71) Applicant: PIUSI S.P.A., Suzzara (IT)

(72) Inventor: Otto Varini, Suzzara (IT)

(73) Assignee: PIUSI S.P.A., Suzzara (IT)

( * ) Notice: Subject to any disclaimer, the term of this patent is extended or adjusted under 35 U.S.C. 154(b) by 68 days.

(21) Appl. No.: 17/482,680

(22) Filed: Sep. 23, 2021

(65) Prior Publication Data

US 2022/0092906 A1 Mar. 24, 2022

(30) Foreign Application Priority Data

Sep. 24, 2020 (IT) ..... 102020000022516

(51) Int. Cl.

| | |
|---|---|
| ***B67D 7/14*** | (2010.01) |
| ***G07F 13/02*** | (2006.01) |
| ***G07F 9/00*** | (2006.01) |
| ***B67D 7/04*** | (2010.01) |

(52) U.S. Cl.

CPC ..... *G07F 9/009* (2020.05); *B67D 7/04* (2013.01); *B67D 7/145* (2013.01); *G07F 9/001* (2020.05); *G07F 13/025* (2013.01)

(58) Field of Classification Search

CPC ..... G07F 13/025; G07F 9/001; B67D 7/145; B67D 7/04; B67D 7/348

See application file for complete search history.

(56) References Cited

U.S. PATENT DOCUMENTS

2005/0123408 A1 6/2005 Koehl
2014/0327778 A1* 11/2014 Mcquade ..... H04L 63/107 700/237
2015/0306967 A1* 10/2015 Cohen ..... B60L 53/68 701/34.2

(Continued)

FOREIGN PATENT DOCUMENTS

EP 1 881 201 A2 1/2008
EP 2 881 582 A1 6/2015

(Continued)

OTHER PUBLICATIONS

Italian Search Report and Written Opinion dated May 18, 2021 received in Italian Patent Application No. IT 2020000022516, together with an English-language translation.

*Primary Examiner* — Jason K Niesz

(74) *Attorney, Agent, or Firm* — Scully, Scott, Murphy & Presser, P.C.

(57) ABSTRACT

A system for controlling the dispensing of fuel or the like in a vending apparatus, particularly for private use, comprising one or more dispensing assemblies, one or more mobile processing devices, and a central remote processing device, the mobile devices being configured to transmit data originating from the dispensing assemblies toward the central remote device.

Each dispensing assembly comprises an electronic controller and dispensing element which comprise an electric pump, the electronic controller being configured to control electronically the electric pump of the dispensing element on the basis of the occurrence of an operating condition of the electrical and/or hydraulic type of the dispensing element of the dispensing assembly.

22 Claims, 3 Drawing Sheets

(56) References Cited

U.S. PATENT DOCUMENTS

| | | | | |
|---|---|---|---|---|
| 2017/0183215 | A1 | 6/2017 | Ayers et al. | |
| 2018/0016131 | A1* | 1/2018 | Varini | G07F 13/025 |
| 2020/0236175 | A1* | 7/2020 | Wang | H04W 4/20 |

FOREIGN PATENT DOCUMENTS

| | | | |
|---|---|---|---|
| EP | 3 272 705 | A1 | 1/2018 |
| WO | 2015/071770 | A2 | 5/2015 |

* cited by examiner

SYSTEM FOR CONTROLLING THE DISPENSING OF FUEL OR THE LIKE IN A VENDING APPARATUS, PARTICULARLY FOR PRIVATE USE

The present invention relates to a system for controlling the dispensing of fuel or the like in a fixed or mobile vending apparatus, particularly but not exclusively useful and practical in the field of apparatuses for vending fuels, additives and mixtures thereof for private use which are used for example by companies that operate in the field of freight transport, logistics, shipping or agriculture, or by private citizens whose hobby is cars, to refuel their motor vehicles.

Fuel vending apparatuses of the known type are currently provided with one or more dispensing assemblies, for example in the form of upright gas pumps, each dispensing assembly being adapted to refuel a motor vehicle of a user, i.e., adapted to dispense the fuel, for example gasoline, diesel fuel, LPG or the like, into the tank of said motor vehicle driven by said user, for example a driver who works for a transport company.

Refueling entails stopping the motor vehicle in an adapted area proximate to a dispensing assembly, inserting a dispenser or a dispensing nozzle into the filler which provides access to the tank of said motor vehicle, and beginning the dispensing of fuel into said tank.

However, fuel vending apparatuses, particularly for private use, of the known type are not free from drawbacks, which include the fact that these known solutions, for example adopted by transport companies, lead to operations for refueling motor vehicles which are often indiscriminate and uncontrolled, in particular because no payment is required before or after fuel dispensing.

Fuel vending apparatuses, particularly for private use, of the known type in fact do not track or record in any way the various refueling operations performed by them. Anyone among the users who have access to one of these known apparatuses can perform an indefinite number of refueling operations of a motor vehicle without these operations being in any way tracked or recorded.

Another drawback of fuel vending apparatuses, particularly for private use, of the known type resides in the fact that they do not offer a user in charge, for example the owner or manager of a transport company, the possibility to monitor the refueling operations performed by means of these known apparatuses, as well as their operating status, for example in terms of effectiveness and efficiency of the mechanical and/or electrical parts comprised in the dispensing assemblies.

A further drawback of fuel vending apparatuses, particularly for private use, of the known type resides in the fact that they have few or no measures for optimizing energy consumption, particularly of electric current, and for the electrical safety of the dispensing assemblies.

The aim of the present invention is to overcome the limitations of the background art described above, by devising a system for controlling the dispensing of fuel or the like in a fixed or movable vending apparatus, particularly for private use, which makes it possible to obtain higher levels of effectiveness and efficiency in the refueling of motor vehicles than those obtainable with known solutions and/or similar levels of effectiveness and efficiency at a lower cost.

Within this aim, an object of the present invention is to conceive a system for controlling the dispensing of fuel or the like in a vending apparatus, particularly for private use, which allows tracking and controlling the quantity of fuel dispensed in each instance for the refueling of a specific motor vehicle driven by a specific user.

Another object of the present invention is to devise a system for controlling the dispensing of fuel or the like in a vending apparatus, particularly for private use, that allows monitoring the refueling operations performed by means of the apparatus, as well as the operating status thereof, in particular of the mechanical and/or electrical parts comprised in the dispensing assemblies, consequently reducing the onset of any malfunctions in said dispensing assemblies.

A further object of the present invention is to conceive a system for controlling the dispensing of fuel or the like in a vending apparatus, particularly for private use, that makes it possible to optimize the energy consumption, particularly of electric current, of the dispensing assemblies.

Another object of the present invention is to conceive a system for controlling the dispensing of fuel or the like in a vending apparatus, particularly for private use, that makes it possible to increase the levels of effectiveness and efficiency of the dispensing assemblies.

Another object of the present invention is to devise a system for controlling the dispensing of fuel or the like in a vending apparatus, particularly for private use, that makes it possible to perform control of the accesses of the users to the apparatus, consequently increasing the level of general security at the apparatus.

Another object of the present invention is to provide a system for controlling the dispensing of fuel or the like in a vending apparatus, particularly for private use, that is highly reliable, relatively simple to provide, and economically competitive if compared with the background art.

This aim, as well as these and other objects which will become more apparent hereinafter, are achieved by a system for controlling the dispensing of fuel or the like in a fixed or mobile vending apparatus, particularly for private use, comprising one or more dispensing assemblies, one or more mobile processing devices operated by respective driver users, and a central remote processing device, said mobile devices being connected to and communicating with said central remote device via a telematic communication network, said dispensing assemblies and said mobile processing devices comprising respective short-range wireless communication modules configured to establish a short-range wireless communication between said dispensing assemblies and said mobile devices, said mobile devices being configured to transmit data originating from said dispensing assemblies toward said central remote processing device, said system being characterized in that each dispensing assembly comprises an electronic controller and dispensing means which comprise an electric pump, said electronic controller being configured to control electronically said electric pump of said dispensing means on the basis of the occurrence of an operating condition of the electrical and/or hydraulic type of said dispensing means of said dispensing assembly.

Further characteristics and advantages of the invention will become more apparent from the description of preferred but not exclusive embodiments of a system for controlling the dispensing of fuel or the like in a vending apparatus, particularly for private use, according to the invention, illustrated by way of non-limiting example with the aid of the accompanying drawings, wherein.

Figure 1:
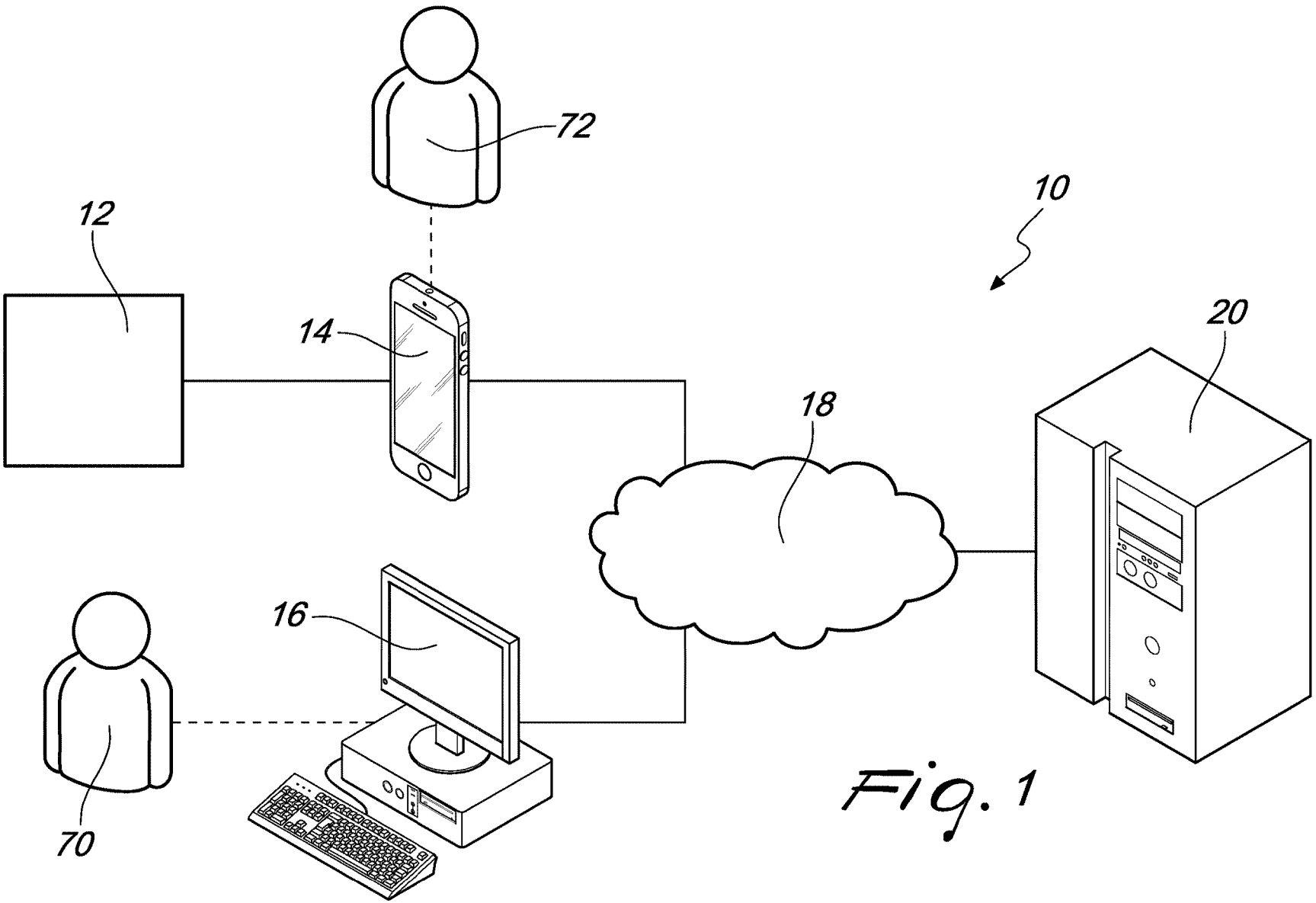
FIG. 1 is a block diagram which shows schematically an embodiment of a system for controlling the dispensing of fuel or the like in a vending apparatus, particularly for private use, according to the present invention.

With particular reference to FIG. 1, a system for controlling the dispensing of fuel or the like in a fixed or mobile vending apparatus, particularly for private use, according to the invention, designated generally by the reference numeral 10, comprises substantially one or more dispensing assemblies 12, one or more mobile processing devices 14, at least one managing and processing device 16, and a central remote processing device 20. The mobile processing device 14 and the managing and processing device 16 are connected to and communicate with the central remote processing device 20 via a telematic communication network 18, such as for example the Internet.

It should be noted that, within the scope of the present invention, the dispensing assemblies 12 are each associated with a respective storage tank which is fixed (for example underground) or mobile (for example on board of a truck or pickup). Furthermore, the dispensing assemblies 12 can be arranged even at great distances from each other, for example in different cities, but also in different regions or even in different states.

The mobile processing device 14, mobile device 14 in short, such as for example a smartphone or a tablet, is operated by a driver user 72 of the system 10 according to the invention, such as for example a driver employed by a transport company, who refuels his own motor vehicle when necessary.

The managing and processing device 16, in short manager device 16, such as for example a desktop computer but also a smartphone or a tablet, is instead operated by a user 70 in charge of the system 10 according to the invention, such as for example the owner or manager of a transport company, who supervises the activities of the vending apparatus, in particular the refueling operations, and monitors the consumption of fuel and the operating status of said vending apparatus.

Figure 2:
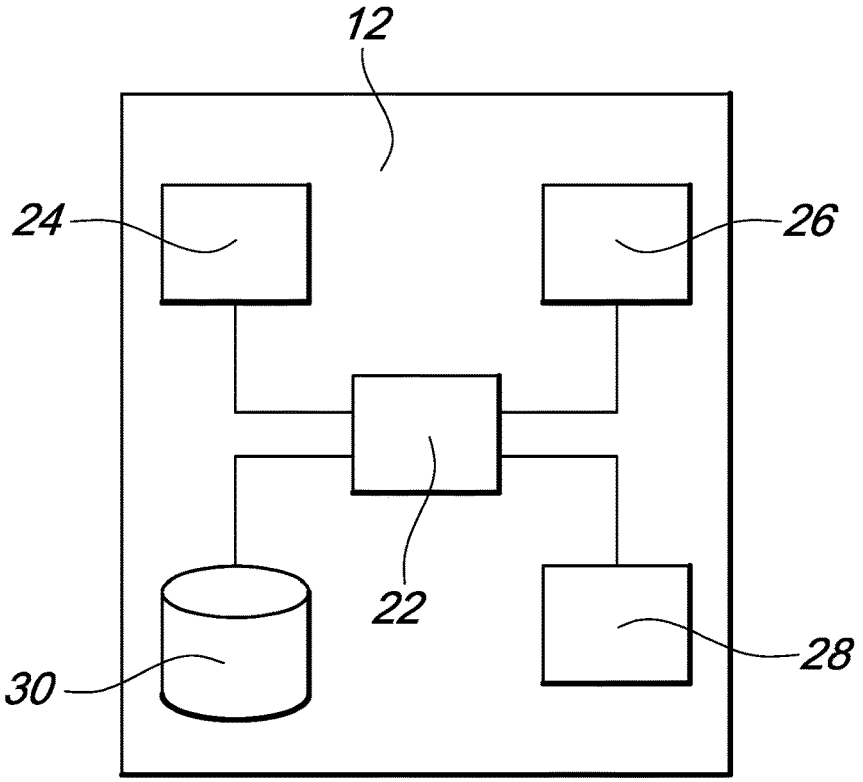
FIG. 2 is a block diagram which shows schematically an embodiment of the dispensing assembly of the system for controlling the dispensing of fuel or the like in a vending apparatus, particularly for private use, according to the present invention.

With particular reference to FIG. 2, each dispensing assembly 12 of the system 10 for controlling the dispensing of fuel or the like in a vending apparatus according to the invention comprises: a control unit or electronic controller 22, dispensing means 24, a short-range wireless communication module 26, authentication means 28, and local storage means 30.

Preferably, the control unit or electronic controller 22 and the short-range wireless communication module 26 are associated with the dispensing means 24. Advantageously, the local storage means 30 also are associated with the dispensing means 24. In practice, the control unit or electronic controller 22, the dispensing means 24, the short-range wireless communication module 26 and the local storage means 30 can be arranged within the same body.

The dispensing means 24 of the dispensing assembly 12 are adapted to draw the fuel or the like from the storage tank with which they are associated and to dispense the fuel or the like thus drawn into the tank of a motor vehicle.

Figure 3:
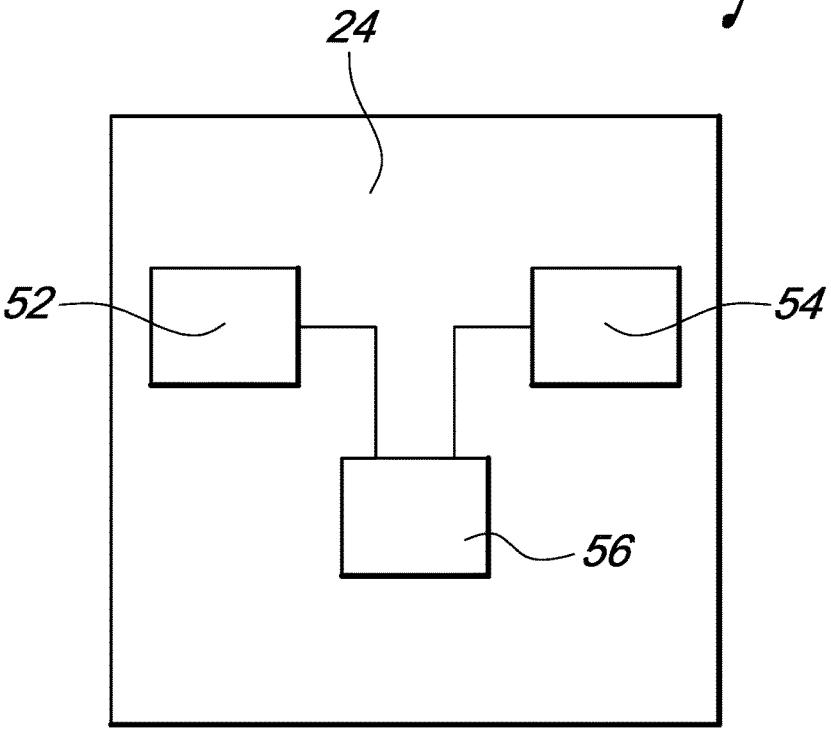
FIG. 3 is a block diagram which shows schematically an embodiment of the dispensing means of the dispensing assembly of the system for controlling the dispensing of fuel or the like in a vending apparatus, particularly for private use, according to the present invention.

With particular reference to FIG. 3, the dispensing means 24 comprise at least one pump or pumping element 56, particularly of the electrical type, i.e., an electric pump. Advantageously, the dispensing means 24 further comprise at least one flow rate sensor 52. Advantageously, the dispensing means 24 further comprise at least one filter or filtering assembly 54.

Preferably, the control unit or electronic controller 22 and the short-range wireless communication module 26 are associated with the electric pump 56 of the dispensing means 24. Advantageously, the local storage means 30 also are associated with the electric pump 56 of the dispensing means 24. In practice, the control unit or electronic controller 22, the electric pump 56 of the dispensing means 24, the short-range wireless communication module 26 and the local storage means 30 can be arranged inside the same body.

In one preferred embodiment of the system 10 for controlling the dispensing of fuel or the like in a vending apparatus according to the invention, the dispensing means 24 comprise a flow rate sensor 52, a filter 54 and an electric pump 56 for each available fuel type: for example, a first flow rate sensor, a first filter and a first electric pump for gasoline, a second fuel flow rate sensor, a second filter and a second electric pump for diesel fuel, and so forth.

The control unit or electronic controller 22 is the main functional element of the dispensing assembly 12 of the system 10 for controlling the dispensing of fuel or the like in a vending apparatus according to the invention; as shown in FIG. 2, the electronic controller 22 is in fact connected to and communicates with the other operating and/or functional elements comprised in the dispensing assembly 12.

The electronic controller 22 is provided with suitable capabilities for computing and interfacing with the other elements of the dispensing assembly 12 of the system 10 according to the invention and is adapted to control, manage and coordinate the operation of the elements of the dispensing assembly 12 to which it is connected and with which it communicates, and to perform the operations for processing the data that originate from these elements of the dispensing assembly 12 and/or from the mobile device 14, returning the corresponding results to them.

The electronic controller 22 of the dispensing assembly 12 is configured to control electronically the electric pump 56 of the dispensing means 24, in particular the rotation rate of the electric motor of said electric pump 56, on the basis of the occurrence of an operating condition of the electrical and/or hydraulic type of the dispensing means 24 of the dispensing assembly 12.

The control of the electric pump 56 of the dispensing means 24, performed by the electronic controller 22, makes it possible to both optimize energy consumption, particularly of electric current, and to increase the level of electrical safety of said electric pump 56 and accordingly of the dispensing assembly 12.

In one embodiment of the system 10 for controlling the dispensing of fuel or the like in a vending apparatus use according to the invention, the electronic controller 22 of the dispensing assembly 12 is configured to monitor an electric current absorbed by the electric motor of the electric pump 56 of the dispensing means 24.

The instantaneous value of this absorbed electric current can be used by the electronic controller 22 as an operating parameter, in this case of the electrical type, in order to assess the operating condition of the dispensing means 24 of the dispensing assembly 12.

In one embodiment of the system 10 for controlling the dispensing of fuel or the like in a vending apparatus according to the invention, the electronic controller 22 of the dispensing assembly 12 is configured to monitor a temperature of the electric motor of the electric pump 56 of the dispensing means 24.

The instantaneous value of this temperature can be used by the electronic controller 22 as an operating parameter, in this case of the electrical type, in order to assess the operating condition of the dispensing means 24 of the dispensing assembly 12.

The temperature of the electric motor of the electric pump 56 is detected by means of a temperature sensor which is connected to the electronic controller 22 and is arranged in contact with or proximate to the hottest spots of said electric motor of the electric pump 56.

In one embodiment of the system 10 for controlling the dispensing of fuel or the like in a vending apparatus according to the invention, the electronic controller 22 of the dispensing assembly 12 is configured to monitor a flow rate of fuel or the like dispensed by the electric pump 56 of the dispensing means 24.

The instantaneous value of this flow rate can be used by the electronic controller 22 as an operating parameter, in this case of the hydraulic type, in order to assess the operating condition of the dispensing means 24 of the dispensing assembly 12.

The flow rate of fuel or the like dispensed by the electric pump 56 is detected by means of a flow rate sensor or flow meter or liter counter 52 connected to the electronic controller 22, for example arranged along a duct in output from said electric pump 56.

In one preferred embodiment of the system 10 for controlling the dispensing of fuel or the like in a vending apparatus according to the invention, the electronic controller 22 of the dispensing assembly 12 is configured to monitor a combination of the operating parameters cited above, i.e., a plurality of operating parameters of the dispensing means 24 selected from the group constituted by: the electric current absorbed by the electric motor of the electric pump 56, the temperature of the electric motor of the electric pump 56, and the flow rate of fuel or the like dispensed by the electric pump 56.

In one embodiment of the system 10 for controlling the dispensing of fuel or the like in a vending apparatus according to the invention, the operating condition for the control of the electric pump 56 of the dispensing means 24, performed by the electronic controller 22, consists in the passing of a threshold of electric current, for example equal to 20 amps, absorbed by the electric motor of said electric pump 56, and in the nil flow rate of fuel or the like dispensed by said electric pump 56 of the dispensing means 24 (i.e., the dispenser or dispensing nozzle are closed).

Upon the occurrence of the above cited operating condition, the electronic controller 22 is configured to slow the rotation rate of the electric motor of the electric pump 56 of the dispensing means 24, in order to save electric power and avoid mechanical stress to said electric motor. Furthermore, it should be noted that by means of this solution it is possible to avoid the fitting of a mechanical bypass.

In one embodiment of the system 10 for controlling the dispensing of fuel or the like in a vending apparatus according to the invention, the operating condition for the control of the electric pump 56 of the dispensing means 24, performed by the electronic controller 22, consists in the passing of at least one first temperature threshold, for example equal to 75, 90 or 100° C., of the electric motor of said electric pump 56.

Upon the occurrence of this operating condition cited above, the electronic controller 22 is configured to slow the rotation rate of the electric motor of the electric pump 56 of the dispensing means 24 in order to maintain a point of thermal equilibrium of said electric motor.

In one embodiment of the system 10 for controlling the dispensing of fuel or the like in a vending apparatus according to the invention, the operating condition for the control of the electric pump 56 of the dispensing means 24, performed by the electronic controller 22, consists in the passing of a second temperature threshold, for example equal to 120° C., of the electric motor of said electric pump 56.

Upon the occurrence of this operating condition cited above, the electronic controller 22 is configured to stop the rotation of the electric motor, i.e., to turn off the electric motor, of the electric pump 56 of the dispensing means 24, in order to avoid malfunctions and consequently increase the reliability of said electric motor.

In one embodiment of the system 10 for controlling the dispensing of fuel or the like in a vending apparatus according to the invention, the operating condition for the control of the electric pump 56 of the dispensing means 24, performed by the electronic controller 22, consists in the passing of a time threshold of consecutive operation, for example equal to20 minutes, of the electric motor of said electric pump 56.

Upon the occurrence of this operating condition cited above, the electronic controller 22 is configured to stop the rotation of the electric motor, i.e., turn off the electric motor, of the electric pump 56 of the dispensing means 24, in order to avoid malfunctions and consequently increase the reliability of said electric motor.

In one preferred embodiment of the system 10 for controlling the dispensing of fuel or the like in a vending apparatus according to the invention, the electronic controller 22 of the dispensing assembly 12 is configured to assess a combination of the operating conditions cited above, controlling electronically the electric pump 56 of the dispensing means 24 on the basis of the occurrence of at least one of these operating conditions of the electrical and/or hydraulic type of the dispensing means 24 of the dispensing assembly 12.

In one embodiment of the system 10 for controlling the dispensing of fuel or the like in a vending apparatus according to the invention, the electronic controller 22 of the dispensing assembly 12 is further configured to assess whether the filter or filtering assembly 54 of the dispensing means 24 of the dispensing assembly 12 is clogged, and therefore needs to be replaced, on the basis of a pair of monitored operating parameters already described above, in particular: the electric current absorbed by the electric motor of the electric pump 56 and the flow rate of fuel or the like dispensed by the electric pump 56.

Within the scope of this embodiment, it may be necessary to define a pair of reference parameters upon the first use of the dispensing assembly 12, in particular of the dispensing means 24. The procedure for defining this pair of reference parameters consists in:

dispensing fuel or the like at the maximum possible flow rate, for example by completely opening the dispenser or the dispensing nozzle, or in any case opening completely all and any throttling elements;

acquiring the reference parameters of the electric current absorbed by the electric motor of the electric pump 56 and the flow rate of fuel or the like dispensed by the electric pump 56, by means of the electronic controller 22.

In practice, the electronic controller 22 of the dispensing assembly 12 can be configured to define a reference parameter of the absorbed electric current and a reference parameter of the flow rate of fuel or the like dispensed by the electric pump 56 of the dispensing means 24, in a state of dispensing fuel or the like at the maximum possible flow rate.

When, after a certain period of time, the dispensing of fuel or the like at the maximum possible flow rate is repeated, the electronic controller 22 assesses the variation of the pair of monitored operating parameters with respect to the pair of reference parameters defined previously. As a consequence of this comparison, the electronic controller 22 generates and sends a signal to the mobile device 14 and/or to the manager device 16, which in turn generate and display a feedback or a notification to the respective user 72, 70 in order to communicate alternatively that:

the filter 54 is clean and efficient;

the filter 54 is beginning to become clogged and its replacement is recommended; or the filter 54 is very clogged and its replacement is absolutely necessary.

The short-range wireless communication module 26 of the dispensing assembly 12, preferably of the Bluetooth type and even more preferably of the BTLE (Bluetooth Low Energy) type, is suitable for the connection and preferably bidirectional communication of the dispensing assembly 12, particularly of the corresponding electronic controller 22, with the mobile device 14. For this purpose, the short-range wireless communication module 26 comprises an antenna, preferably of the Bluetooth type and even more preferably of the BTLE (Bluetooth Low Energy) type.

In the preferred embodiment of the system 10 for controlling the dispensing of fuel or the like in a vending apparatus according to the invention, in which the short-range wireless communication module 26 of the dispensing assembly 12 is of the Bluetooth type, this Bluetooth module 26 can contain a microcontroller adapted to manage Bluetooth communication with the mobile device 14, according to the associated protocols, and adapted to manage radio transmission via an antenna provided directly on the printed circuit.

The local storage means 30 of the dispensing assembly 12 are adapted to store the information and data which are related to the dispensing assembly 12 and are therefore referable to all the refueling operations performed thereat.

Advantageously, the local storage means 30 contain one or more data items related to the dispensing assembly 12 selected from the group constituted by: a history of the electric current absorbed by the electric motor of the electric pump 56 of the dispensing means 24, a history of the temperature of the electric motor of the electric pump 56 of the dispensing means 24, and a history of the flow rate of fuel or the like dispensed by the electric pump 56 of the dispensing means 24.

Advantageously, the local storage means 30 contain one or more data items related to the dispensing assembly 12, selected from the group constituted by: the standby life time of the electric pump 56 of the dispensing means 24, the dispensing life time of the electric pump 56 of the dispensing means 24, and the number of interventions related to the various operating conditions (for example, jammed motor, excess currents, excess temperatures, monitoring of the channels of the pulser if it is a pulser of the dual-channel type).

In one embodiment of the system 10 for controlling the dispensing of fuel or the like in a vending apparatus according to the invention, the local storage means 30 of the dispensing assembly 12 are further adapted to store a list of the driver users 72 who are registered and authorized at said dispensing assembly 12, i.e., a plurality of user records, each user record comprising the access data of a respective driver user 72, such as for example the name and surname of the driver user 72, the PIN code and the ID code.

The PIN code is typically a numeric code associated with a driver user 72, while the ID code is typically a numeric or alphanumeric code associated with a driver user 72 or with a mobile device 14. In one embodiment, the ID code is a unique code associated with the mobile device 14 of the driver user 72, such as for example the IMEI (International Mobile Equipment Identity) code.

In practice, the local storage means 30 of the dispensing assembly 12 can comprise a database suitable to store a list of the driver users 72 who are registered and authorized at said dispensing assembly 12, so that the driver user 72 can obtain the authorization to use the dispensing assembly 12 in order to refuel his own motor vehicle, even if the signal or connection to the telematic communication network 18 is temporarily not available for communication with the central remote processing device 20.

By way of example, the local storage means 30 of the dispensing assembly 12 can store the following information and data items: list of driver users 72 registered and authorized at the dispensing assembly 12, PIN code associated with each driver user 72, ID code of each mobile device 14, identification code of the individual refueling operation, date and time of the individual refueling operation, quantity of fuel dispensed in the individual refueling operation, location data of the individual refueling operation, identification code of the driver user 72 who performed the individual refueling operation, name and surname of the driver user 72 who performed the individual refueling operation, registration plate of the motor vehicle refueled in the individual refueling operation, make and/or model of the motor vehicle refueled in the individual refueling operation, total mileage (for example total kilometers or miles) of the motor vehicle refueled in the individual refueling operation, history of the electric current absorbed by the electric motor of the electric pump 56 of the dispensing means 24 of the dispensing assembly 12, history of the temperature of the electric motor of the electric pump 56 of the dispensing means 24 of the dispensing assembly 12, history of the flow rate of fuel or the like dispensed by the electric pump 56 of the dispensing means 24 of the dispensing assembly 12, standby life time of the electric pump 56 of the dispensing means 24 of the dispensing assembly 12, dispensing life time of the electric pump 56 of the dispensing means 24 of the dispensing assembly 12.

The data stored in the local storage means 30 or a selection thereof can be transmitted from the dispensing assembly 12 towards the central remote processing device 20 by means of the mobile device 14, as explained in greater detail in the continuation of the present description.

In one embodiment of the system 10 for controlling the dispensing of fuel or the like in a vending apparatus according to the invention, the local storage means 30 of the dispensing assembly 12 comprise a database which is stored in appropriately sized memory media.

The authentication means 28 of the dispensing assembly 12 are adapted to authenticate the driver user 72 by verifying the identity of said user who wishes to refuel his own motor vehicle; in the case of a positive outcome, and if the authenticated user is included in the list of the registered and authorized driver users 72, authorizing him to use the dispensing assembly 12 in order to perform said refueling operation.

In one preferred embodiment of the system 10 for controlling the dispensing of fuel or the like in a vending apparatus according to the invention, the authentication means 28 of the dispensing assembly 12 comprise an iButton device reader, adapted to detect and recognize a plurality of iButton devices owned by the driver users 72, in particular a unique iButton device for each one of the driver users 72. Each driver user 72 owns his own unique iButton device.

The iButton device is a chip enclosed in a small enclosure which is sturdy and resistant to atmospheric agents, typically made of stainless steel.

The metallic enclosure of the iButton device is used as an electronic communication interface: the enclosure has a data contact, known as lid, and a ground contact, known as base. Each one of these contacts is connected to the silicon chip inside the enclosure. The lid is in the upper part of the enclosure, while the base constitutes the side walls and the bottom of the enclosure and can comprise a flange for simplifying the fastening of the iButton to any object.

Every iButton device has a unique and unchangeable address etched into its chip inside the metallic enclosure. The address (for example 2700000095C33108) can be used as a key or an identifier for each iButton device and, within the scope of the present invention, makes it possible to identify uniquely the driver user 72.

In this embodiment, the local storage means 30 of the dispensing assembly 12 further store the identification data comprised in the plurality of iButton devices owned by the driver users 72, particularly the identification data comprised in the unique iButton device of each one of the driver users 72. Advantageously, the remote storage means 38 of the central remote processing device 20 also further contain the identification data comprised in the plurality of iButton devices owned by the driver users 72, in particular the identification data comprised in the unique iButton device of each of the driver users 72.

In another embodiment of the system 10 for controlling the dispensing of fuel or the like in a vending apparatus according to the invention, the authentication means 28 of the dispensing assembly 12 comprise a biometric parameter reader, adapted to detect and recognize a plurality of biometric parameters related to the driver users 72, in particular at least one unique biometric parameter for each one of the driver users 72. Preferably, the biometric parameter reader of the authentication means 28 of the dispensing assembly 12 is a fingerprint reader and therefore the biometric parameter detected and recognized thereby is a fingerprint.

In this embodiment, the local storage means 30 of the dispensing assembly 12 further contain the plurality of biometric parameters related to the driver users 72, in particular at least one unique biometric parameter for each one of the driver users 72. Advantageously, the remote storage means 38 of the central remote processing device 20 also further contain the plurality of biometric parameters related to the driver users 72, in particular at least one unique biometric parameter for each of the driver users 72.

In another embodiment of the system 10 for controlling the dispensing of fuel or the like in a vending apparatus according to the invention, the authentication means 28 of the dispensing assembly 12 comprise an RFID (Radio-Frequency IDentification) tag reader adapted to detect and recognize a plurality of RFID tags owned by the driver users 72, in particular a unique RFID tag for each one of the driver users 72. Each driver user 72 has his own unique RFID tag.

In this embodiment, the local storage means 30 of the dispensing assembly 12 further contain the identification data comprised in the plurality of RFID tags owned by the driver users 72, in particular the identification data comprised in the unique RFID tag of each one of the driver users 72. Advantageously, the remote storage means 38 of the central remote processing device 20 also further contain the identification data comprised in the plurality of RFID tags owned by the driver users 72, in particular the identification data comprised in the unique RFID tag of each one of the driver users 72.

In another embodiment of the system 10 for controlling the dispensing of fuel or the like in a vending apparatus according to the invention, the authentication means 28 of the dispensing assembly 12 comprise an NFC (Near-Field Communication) tag reader, adapted to detect and recognize a plurality of NFC tags owned by the driver users 72, in particular a unique NFC tag for each one of the driver users 72. Each driver user 72 has his own unique NFC tag.

In this embodiment, the local storage means 30 of the dispensing assembly 12 further contain the identification data comprised in the plurality of NFC tags owned by the driver users 72, in particular the identification data comprised in the unique NFC tag of each one of the driver users 72. Advantageously, the remote storage means 38 of the central remote processing device 20 also further contain the identification data comprised in the plurality of NFC tags owned by the driver users 72, in particular the identification data comprised in the unique NFC tag of each one of the driver users 72.

The dispensing assembly 12 can be configured so as to enable the dispensing of fuel for refueling a motor vehicle only following the positive outcome of the authentication of the driver user 72 via said authentication means 28, and if the authenticated user is included in the list of the driver users 72 who are registered and authorized at the dispensing assembly 12.

In one embodiment of the system 10 for controlling the dispensing of fuel or the like in a vending apparatus according to the invention, the electronic controller 22 of the dispensing assembly 12 is further configured to calculate a value of the current level of fuel or the like contained in the storage tank associated with the dispensing assembly 12, particularly by calculating the difference between a value of the previous level of fuel or the like and a value of fuel or the like dispensed during a refueling operation.

The value of the previous level of fuel or the like can be set by the user 70 in charge by means of the managing and processing device 16, or can be the result of a refueling operation.

The value of dispensed fuel or the like can be calculated by multiplying the flow rate of fuel or the like dispensed by the electric pump 56 of the dispensing means 24 by the dispensing time, i.e., by the operating time of the electric pump 56 of the dispensing means 24 during the refueling operation.

As has been mentioned, the electronic controller 22 of the dispensing assembly 12 can be configured to monitor the flow rate of fuel or the like dispensed by the electric pump 56 of the dispensing means 24.

In one embodiment of the system 10 for controlling the dispensing of fuel or the like in a vending apparatus according to the invention, the dispensing assembly 12 further comprises one or more level contacts of the fuel or the like, for example of the floater type, which are connected to the electronic controller 22 and are arranged in the storage tank associated with the dispensing assembly 12. Each level contact of the fuel or the like is configured to signal to the electronic controller 22 when the current level of fuel or the like contained in the storage tank associated with the dispensing assembly 12 reaches a respective predefined value.

In one embodiment of the system 10 for controlling the dispensing of fuel or the like in a vending apparatus according to the invention, the dispensing assembly 12 comprises further a sensor of the level of the fuel or the like connected to the electronic controller 22 and arranged in the storage tank associated with the dispensing assembly 12. Preferably, the level sensor is of the analog or digital continuous measurement type. The level sensor of the fuel or the like is configured to signal to the electronic controller 22 a value of the current level of fuel or the like contained in the storage tank associated with the dispensing assembly 12.

In the three embodiments that have just been described, among the data transmitted from the dispensing assembly 12 toward the central remote processing device 20, via the mobile processing device 14, it is also possible to comprise the value of the current level of fuel or the like contained in the storage tank associated with the dispensing assembly 12, i.e., in the storage tank of the vending apparatus, for example calculated by calculating the difference between the value of the previous level of fuel or the like and the value of fuel or the like that has been dispensed, or detected by the level sensor.

Advantageously, the value of the current level of fuel or the like contained in the storage tank associated with the dispensing assembly 12 can be used by the electronic controller 22, which generates and sends a signal to the mobile device 14 and/or to the manager device 16, which in turn generate and display a feedback or a notification to the respective user 72, 70 to communicate that, for example:

- a reserve level has been reached; or
- an electric pump blocking level has been reached (i.e., level too low for dispensing).

The mobile processing device 14, which as mentioned is constituted for example by a smartphone or a tablet, is capable of processing information and data in response to instructions provided by the driver user 72 or by third-party devices, and to run applications or software modules installed in it.

The mobile device 14 comprises display means, for example to present the graphical interfaces to the driver user 72, and input and selection means, for example for the entry of data and/or commands by the driver user 72.

The mobile device 14 is provided with suitable capabilities for computing and interfacing with third-party devices connected thereto, such as for example the central remote processing device 20 which can be reached via the telematic communication network 18.

As has been mentioned, the mobile device 14 is connected to and communicates with the central remote device 20 via the telematic communication network 18. Therefore, the mobile device 14 comprises means for connection and communication with the central remote device 20 via the telematic communication network 18.

The mobile device 14 is configured to transmit the data that originate from the dispensing assembly 12 towards the central remote processing device 20, but also to receive the data that originate from the central remote processing device 20 and are intended for the dispensing assembly 12. For example, these last data can be related to the synchronization of the list of driver users 72 who are registered and authorized at said dispensing assembly 12, or to the configuration of the operating parameters of the latter. This transmission and this reception of data occur via the telematic communication network 18.

It should be noted that within the system 10 for controlling the dispensing of fuel or the like in a vending apparatus according to the invention, the mobile device 14 does not necessarily have to be connected to the telematic communication network 18 except during the transmission of data towards the central remote processing device 20 or the reception of data originating from it. Therefore, the system 10 according to the invention can also operate, for example, in the absence of signal or of connection to the telematic communication network 18.

In one preferred embodiment of the system 10 for controlling the dispensing of fuel or the like in a vending apparatus according to the invention, the mobile processing device 14 further comprises a geolocation module configured to receive a position data item, which comprises the geographic coordinates of said mobile processing device 14, when the driver user 72 refuels his own motor vehicle, i.e., when the mobile device 14 of the driver user 72 is communicating with the dispensing assembly 12 selected for the refueling operation.

In the same preferred embodiment, the mobile device 14 is further configured to transmit the position data item obtained from the geolocation module toward the central remote device 20, together with the information and the data described above which relate to the dispensing assembly 12 and which therefore can refer to all the refueling operations performed thereat. Optionally, the mobile processing device 14 is further configured to send the position data item obtained from the geolocation module towards the dispensing assembly 12.

In a preferred embodiment of the system 10 for controlling the dispensing of fuel or the like in a vending apparatus according to the invention, verification of the identity, i.e., the authentication, of the driver user 72 who wishes to refuel his own motor vehicle consists in the comparison between the user access data comprised in each user record stored in the local storage means 30 of the dispensing assembly 12 and the access data that said driver user enters during authentication via the mobile processing device 14.

In one embodiment, the verification of the identity, i.e., the authentication, of the driver user 72 occurs if the name, surname and PIN code entered by the user during authentication coincide with the name, surname and PIN code stored in one of the user records comprised in the local storage means 30 of the dispensing assembly 12.

In another embodiment, the verification of the correct identity, i.e., the authentication, of the driver user 72 occurs if the name, surname and PIN code entered by the user during authentication in combination with the IMEI code of the mobile device 14 of said user coincide with the name, surname, PIN code and IMEI code stored in one of the user records comprised in the local storage means 30 of the dispensing assembly 12.

In one preferred embodiment of the system 10 according to the invention, each mobile device 14 is assigned exclusively to a corresponding driver user 72, who performs the operations for refueling his own motor vehicle.

In one preferred embodiment of the system 10 according to the invention, each mobile device 14 comprises a unique identification code which allows the dispensing assembly 12 and/or the central remote processing device 20 to distinguish it from the other mobile devices 14, consequently identifying the corresponding driver user 72.

The mobile device 14 comprises a short-range wireless communication module, preferably of the Bluetooth type and even more preferably of the BTLE (Bluetooth Low Energy) type, adapted for the connection and preferably bidirectional communication of the mobile device 14 with the dispensing assembly 12.

In the preferred embodiment of the system 10 according to the invention, in which the short-range wireless communication module of the mobile device 14 is of the Bluetooth type, said Bluetooth module can contain a microcontroller adapted to manage Bluetooth communication with the dispensing assembly 12, according to the corresponding protocols, and to manage radio transmission via an antenna obtained directly on the printed circuit.

In order to establish a preferably bidirectional short-range wireless communication between them, the dispensing assembly 12 and the mobile device 14 are configured to perform pairing operations, i.e., the mutual recognition process that is performed for example when two Bluetooth devices are linked to each other, and which consists in the exchange and verification of a unique identification code, in order to authorize the subsequent exchange of data between said devices.

In other words, once the dispensing assembly 12 and the mobile device 14, and in particular the respective short-range wireless communication modules, are arranged at an appropriate distance (for example in the radius of 10-15 meters) or placed substantially in contact, they exchange recognition information, such as for example a unique identification code which allows mutual recognition.

In one embodiment of the system 10 for controlling the dispensing of fuel or the like in a vending apparatus according to the invention, the dispensing assembly 12 comprises signaling means which are adapted to signal to the driver user 72 the state of the mutual recognition or pairing, which comprise for example a green luminous indicator to signal the positive outcome of the pairing and/or a red luminous indicator to signal the negative outcome of the pairing.

The dispensing assembly 12 can be configured so as to enable the dispensing of fuel for the refueling of a motor vehicle only following the positive outcome of said mutual recognition or pairing between the dispensing assembly 12 and the mobile device 14, and if the user who owns the recognized mobile device 14 is included in the list of the driver users 72 who are registered and authorized at the dispensing assembly 12.

In one preferred embodiment of the system 10 for controlling the dispensing of fuel or the like in a vending apparatus according to the invention, the driver user 72 is authorized and enabled to use the dispensing assembly 12 to refuel his own vehicle only following the positive outcome of a "combined" authentication, which comprises both the authentication of the driver user 72 via the authentication means 28 of the dispensing assembly 12 and the authentication of the driver user 72 via the mutual recognition or pairing between the dispensing assembly 12 and the mobile device 14 owned by said driver user 72; always on condition that said driver user 72 is included in the list of the driver users 72 who are registered and authorized at the dispensing assembly 12.

Advantageously, the driver user 72 is not enabled to use the dispensing assembly 12 to refuel his own motor vehicle for an unlimited time; this enabling is in fact limited in time and its duration corresponds to a period of time which can be adjusted by the user 70 in charge. When the time period of the enabling reaches the end, the driver user 72 is no longer enabled to dispense fuel at the dispensing assembly 12, barring a new operation for authentication, authorization and enabling.

Advantageously, the system 10 for controlling the dispensing of fuel or the like in a vending apparatus according to the invention, and in particular the dispensing assembly 12, is configured to manage an authentication queue which comprises a plurality of driver users 72 who wish to refuel their own motor vehicle. In this manner, each individual refueling operation is associated with the driver user 72 who actually performed it, preventing for example one refueling operation from being associated incorrectly with a driver user 72 who is not involved in this operation.

In one preferred embodiment of the system 10 for controlling the dispensing of fuel or the like in a vending apparatus according to the invention, the mobile device 14 is configured to allow the driver user 72 to enter the total mileage (value of the odometer) of his own motor vehicle at the time of the refueling operation.

In one embodiment, the entry of the total mileage of one's own motor vehicle at refueling time occurs following the pairing between the dispensing assembly 12 and the mobile device 14, or following a specific request made by the driver user 72 by means of his mobile device 14.

In one embodiment, the entry of the total mileage of one's own motor vehicle at refueling time occurs by means of an adapted screen of a graphical interface which is displayed on the mobile device 14 and implemented by means of an adapted app designed for mobile devices.

In one embodiment, the system 10 for controlling the dispensing of fuel or the like in a vending apparatus, particularly the dispensing assembly 12 and/or the central remote device 20, is configured to check that the total mileage thus entered by the driver user 72 at refueling time is higher than the previously entered total mileage.

In practice, the system 10 according to the invention checks the incremental mileage, controlling the value (for example stored in the local storage means 30 of the dispensing assembly 12) of the last total mileage entered by the driver user 72 at each refueling operation, in order to prevent the driver user 72 from being able to make mistakes during the new entry operation. By way of example, if the last entered total mileage has the value of 100,000 km, the driver user 72 is prevented from entering the value of 10,000 km at the next refueling operation.

The managing and processing device 16, which as has been mentioned is constituted for example by a desktop computer but can also be a smartphone or a tablet, is capable of processing information and data in response to instructions supplied by the user 70 in charge or by third-party devices, as well as of running applications or software modules installed therein.

The manager device 16 has appropriate capabilities for computing and interfacing with third-party devices connected thereto, such as for example the central remote processing device 20 which is reachable via the telematic communication network 18.

The manager device 16 communicates with the central remote device 20 via a telematic communication network 18, such as for example the Internet. The manager device 16 therefore comprises means for connection and communication with the central remote device 20, via the telematic communication network 18.

The manager device 16 is further configured to perform pairing operations with the dispensing assembly 12 in order to establish a preferably bidirectional short-range wireless communication between them for sending and receiving information.

The manager device 16 is further configured to send to the electronic controller 22 the list of the driver users 72 who are registered and authorized.

The manager device 16 is configured to allow the user 70 in charge to interact with the central remote processing device 20. By way of example, the manager device 16 interfaces with the central remote processing device 20, offering the user 70 in charge the possibility to: create and update the information and data stored in the local storage means 30 of the dispensing assemblies 12 or in the remote storage means 38 of said central remote processing device 20, synchronizing the list of the driver users 72 who are registered and authorized at the dispensing assemblies 12, configure the operating parameters of the dispensing assemblies 12, or request and display tables and summary charts generated by the reporting module 36.

In one preferred embodiment of the system 10 for controlling the dispensing of fuel or the like in a vending apparatus according to the invention, in the case of a manager device 16 in the form of a desktop computer, the latter can be provided with a web browser, such as for example Mozilla Firefox, Google Chrome or Microsoft Internet Explorer, for displaying a graphical interface of the web type (web application).

In another embodiment of the system 10 according to the invention, in the case of a manager device 16 in the form of a smartphone or tablet, the latter can be provided with an adapted app designed for mobile devices for implementing a graphical interface.

Figure 4:
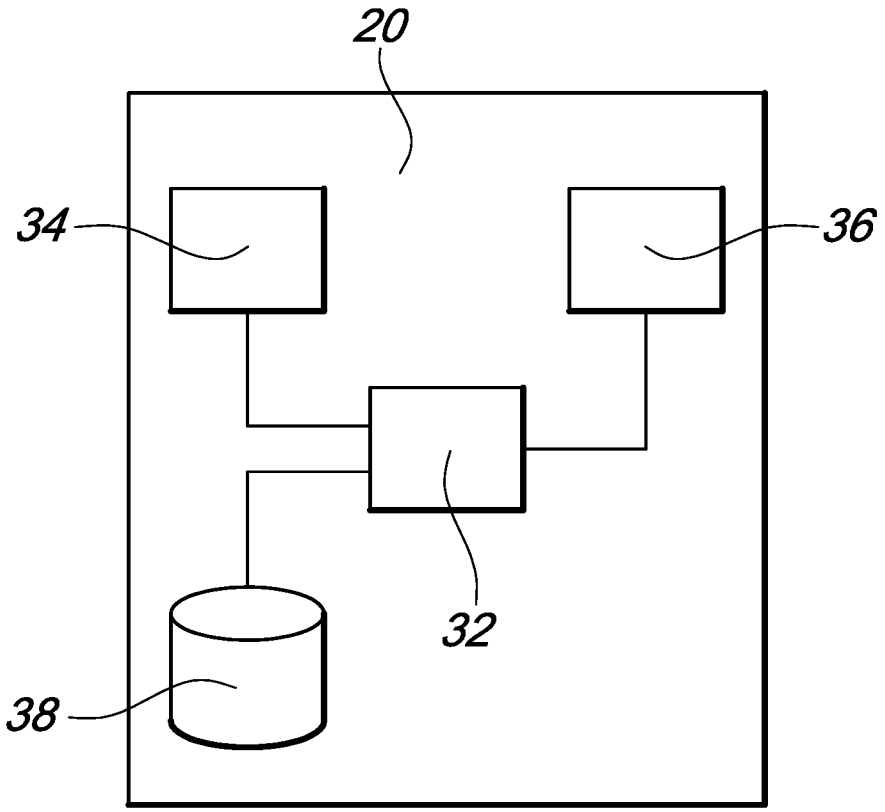
FIG. 4 is a block diagram which shows schematically an embodiment of the central remote processing device of the system for controlling the dispensing of fuel or the like in a vending apparatus, particularly for private use, according to the present invention.

With particular reference to FIG. 4, the central remote processing device 20, in short central remote device 20, is a system of the server type, preferably a web server, and comprises a control unit 32, interface means 34, a reporting module 36, and remote storage means 38.

The central remote processing device 20 further comprises means for connection and communication with the mobile processing device 14 and with the managing and processing device 16 via the telematic communication network 18.

The control unit 32 is the main functional element of the central remote device 20 of the system 10 for controlling the dispensing of fuel or the like in a vending apparatus according to the invention; the control unit 32 is in fact connected to and communicates with the other operating and/or functional elements comprised in the central remote processing device 20.

The control unit 32 has appropriate capabilities for computing and interfacing with the other elements of the central remote processing device 20 of the system 10 according to the invention and is adapted to control, manage and coordinate the operation of the elements of the central remote processing device 20 to which it is connected and with which it communicates, as well as to perform the operations for processing the data that originate from these elements of the central remote device 20, from the mobile device 14 and/or from the manager device 16, returning the corresponding results to them.

The interface means 34 are the means by virtue of which the user 70 in charge interacts in input and in output with the central remote processing device 20. In practice, the interface means 34 offer to the outside a plurality of information items in the form of screens that the user 70 in charge can in each instance select and display by means of the managing and processing device 16.

By way of example, the interface means 34 of the central remote processing device 20 offer the user 70 in charge the possibility to: create and update the information and data stored in the local storage means 30 of the dispensing assemblies 12 or in the remote storage means 38 of said central remote processing device 20, synchronizing the list of the driver users 72 who are registered and authorized at the dispensing assemblies 12, configure the operating parameters of the dispensing assemblies 12, or request and display tables and summary charts generated by the reporting module 36.

In one preferred embodiment of the system 10 for controlling the dispensing of fuel or the like in a vending apparatus according to the invention, in the case of a manager device 16 in the form of a desktop computer, the interface means 34 of the central remote processing device 20 can comprise a graphical interface of the web type (web application) displayed on the manager device 16, provided with a web browser such as for example Mozilla Firefox, Google Chrome or Microsoft Internet Explorer.

In another embodiment of the system 10 according to the invention, in the case of a manager device 16 in the form of a smartphone or tablet, the interface means 34 of the central remote processing device 20 can comprise a graphical interface which is displayed on the manager device 16, implemented by means of an adapted app designed for mobile devices.

The reporting module 36 is adapted to produce and supply, starting from what is stored in the remote storage means 38, information and statistical data related to the refueling operations as a whole and individually, preferably generating tables and summary charts regarding the refueling operations performed by the driver users 72.

The reporting module 36 provides detailed information, optionally in real time, on the refueling operations performed by means of the apparatus and on the amount of fuel dispensed, including for example the number of refueling operations performed by a specific driver user 72 or at a dispensing assembly 12, or the quantity of fuel dispensed by a single dispensing assembly 12 or by a plurality of dispensing assemblies 12; all this can be done both in chart form and in table form.

This can occur for example on the basis of a time interval, on the basis of the city or of the geographical area, on the basis of the driver user 72 (for example by filtering by means of an identification code), on the basis of the motor vehicle (for example by filtering by means of the registration plate), on the basis of the type of fuel, or also on the basis of the dispensing assembly 12.

The reporting module 36 furthermore makes it possible to store the produced reports by storing them in the remote storage means 38.

The remote storage means 38 are adapted to store all the information and data which are related to the system 10 as a whole and which therefore can be related to all the refueling operations performed at all the dispensing assemblies 12, transmitted from the mobile devices 14 to the central remote processing device 20 via the telematic communication network 18.

By way of example, the remote storage means 38 can store the following information and data: list of driver users 72 registered and authorized at each dispensing assembly 12, identification code of each dispensing assembly 12, identification code of the individual refueling operation, date and time of the individual refueling operation, quantity of fuel dispensed in the individual refueling operation, position data of the individual refueling operation, identification code of the driver user 72 who performed the individual refueling operation, name and surname of the driver user 72 who performed the individual refueling operation, registration plate of the motor vehicle refueled in the individual refueling operation, make and/or model of the motor vehicle refueled in the individual refueling operation, total mileage (for example total kilometers or miles) of the motor vehicle refueled in the individual refueling operation, history of the electric current absorbed by the electric motor of the electric pump 56 of the dispensing means 24 of each dispensing assembly 12, history of the temperature of the electric motor of the electric pump 56 of the dispensing means 24 of each dispensing assembly 12, history of the flow rate of fuel or the like dispensed by the electric pump 56 of the dispensing means 24 of each dispensing assembly 12, standby life time of the electric pump 56 of the dispensing means 24 of each dispensing assembly 12, dispensing life time of the electric pump 56 of the dispensing means 24 of each dispensing assembly 12.

Furthermore, the remote storage means 38 can store an account or profile associated with each user 70 in charge or driver 72, and an account or profile associated with each dispensing assembly 12.

In one embodiment of the system 10 for controlling the dispensing of fuel or the like in a vending apparatus according to the invention, the remote storage means 38 of the central remote device 20 comprise a database which is stored on appropriately sized memory media.

In one embodiment of the system 10 for controlling the dispensing of fuel or the like in a vending apparatus according to the invention, the remote storage means 38 can be external to the central remote processing device 20; in this case, the central remote device 20 further comprises means for interfacing with the remote storage means 38.

In practice it has been found that the invention fully achieves the intended aim and objects. In particular it has been shown that the system for controlling the dispensing of fuel or the like in a fixed or mobile vending apparatus, particularly for private use, thus conceived makes it possible to overcome the qualitative limitations of the background art, since it allows to obtaining levels of effectiveness and efficiency in refueling motor vehicles that are higher than those obtainable with known solutions and/or similar levels of effectiveness and efficiency at a lower cost.

One advantage of the system for controlling the dispensing of fuel or the like in a vending apparatus, particularly for private use, according to the present invention resides in the fact that it allows tracking and controlling the quantity of fuel dispensed in each instance for the refueling of a specific motor vehicle driven by a specific user.

Another advantage of the system for controlling the dispensing of fuel or the like in a vending apparatus, particularly for private use, according to the present invention resides in the fact that it allows monitoring the refueling operations performed by means of the apparatus, as well as the operating status thereof, in particular of the mechanical and/or electrical parts comprised in the dispensing assemblies, consequently reducing the onset of any malfunctions in said dispensing assemblies.

A further advantage of the system for controlling the dispensing of fuel or the like in a vending apparatus, particularly for private use, according to the present invention resides in the fact that it makes it possible to optimize the energy consumption, particularly of electric current, of the dispensing assemblies.

Another advantage of the system for controlling the dispensing of fuel or the like in a vending apparatus, particularly for private use, according to the present invention resides in the fact that it makes it possible to increase the levels of effectiveness and efficiency of the dispensing assemblies.

Moreover, an advantage of the system for controlling the dispensing of fuel or the like in a vending apparatus, particularly for private use, according to the present invention resides in the fact that it makes it possible to perform control of the accesses of the users to the apparatus, consequently increasing the general level of security at the apparatus.

Although the system for controlling the dispensing of fuel or the like in a fixed or mobile vending apparatus according to the invention has been conceived in particular for private use, for example for the refueling of motor vehicles used by companies that operate in the fields of freight transport, logistics, shipping or agriculture, or by private citizens whose hobby is cars, it can in any case be used more generally within any apparatus for vending fuel or the like which is used to refuel any motor vehicle.

The invention thus conceived is susceptible of numerous modifications and variations, all of which are within the scope of the appended claims. By way of non-limiting example, the person skilled in the art will understand without effort that a mechanical or electromechanical device can also be provided which can be actuated by a user to stop the dispensing of fuel in the case of emergency. All the details may furthermore be replaced with other technically equivalent elements.

In practice, the materials used, as long as they are compatible with the specific use, as well as the contingent shapes and dimensions, may be any according to the requirements and the state of the art.

To conclude, the scope of the protection of the claims must not be limited by the illustrations or preferred embodiments shown in the description by way of example, but rather the claims must comprise all the characteristics of patentable novelty that reside in the present invention, including all the characteristics that would be treated as equivalents by the person skilled in the art.

The disclosures in Italian Patent Application No. 102020000022516 from which this application claims priority are incorporated herein by reference.

What is claimed is:

1. A system for controlling the dispensing of fuel in a vending apparatus, particularly for private use, comprising one or more dispensing assemblies, one or more mobile processing devices operated by respective driver users, and a central remote processing device, said mobile processing devices being connected to and communicating with said central remote device via a telematic communication network, said dispensing assemblies and said mobile processing devices comprising respective short-range wireless communication modules configured to establish a short-range wireless communication between said dispensing assemblies and said mobile devices, said mobile processing devices being configured to transmit data originating from said dispensing assemblies toward said central remote processing device, wherein each dispensing assembly comprises an electronic controller and dispensing means which comprise an electric pump, said electronic controller being configured to control electronically said electric pump of said dispensing means on the basis of the occurrence of an operating condition of the electrical and/or hydraulic type of said dispensing means of said dispensing assembly, wherein said electronic controller of said dispensing assembly is configured to monitor an electric current absorbed by said electric pump of said dispensing means of said dispensing assembly, an instantaneous value of said absorbed electric current being used by said electronic controller to assess said operating condition of said dispensing means of said dispensing assembly, wherein said electronic controller of said dispensing assembly is configured to monitor a flow rate of fuel or the like dispensed by said electric pump of said dispensing means of said dispensing assembly, said flow rate being detected by means of a flow rate sensor comprised within said dispensing means of said dispensing assembly and connected to said electronic controller, an instantaneous value of said flow rate being used by said electronic controller in order to assess said operating condition of said dispensing means of said dispensing assembly, and wherein said electronic controller of said dispensing assembly is further configured to assess whether a filter comprised in said dispensing means of said dispensing assembly is clogged on the basis of said absorbed electric current and said flow rate of fuel or the like dispensed by said electric pump of said dispensing means of said dispensing assembly.

2. The system for controlling the dispensing of fuel or the like in a vending apparatus according to claim 1, wherein said operating condition for the control of said electric pump of said dispensing means, performed by said electronic controller, consists in the passing of a threshold of electric current absorbed by said electric pump and in the nil flow rate dispensed by said electric pump of said dispensing means;

upon the occurrence of said operating condition, said electronic controller is configured to slow down said electric pump of said dispensing means.

3. The system for controlling the dispensing of fuel or the like in a vending apparatus according to claim 1, wherein said electronic controller of said dispensing assembly is further configured to define a reference parameter of said absorbed electric current and a reference parameter of said flow rate of fuel or the like dispensed by said electric pump of said dispensing means of said dispensing assembly, in a state of dispensing fuel or the like at the maximum flow rate.

4. The system for controlling the dispensing of fuel or the like in a vending apparatus according to claim 1, wherein said short-range wireless communication modules comprised in said dispensing assemblies and in said mobile processing devices are of the Bluetooth type.

5. The system for controlling the dispensing of fuel or the like in a vending apparatus according to claim 1, wherein said electronic controller of said dispensing assembly is further configured to calculate a value of the current level of fuel contained in a tank associated with said dispensing assembly, by calculating the difference between a previous fuel level value and a dispensed fuel value.

6. The system for controlling the dispensing of fuel or the like in a vending apparatus according to claim 1, wherein said dispensing assembly further comprises one or more fuel level contacts which are connected to said electronic controller and are arranged in a tank associated with said dispensing assembly, each fuel level contact being configured to signal to said electronic controller when the current level of fuel contained in said tank associated with said dispensing assembly reaches a respective predefined value.

7. The system for controlling the dispensing of fuel or the like in a vending apparatus according to claim 1, wherein said dispensing assembly further comprises a fuel level sensor which is connected to said electronic controller of said dispensing assembly and is arranged in a tank associated with said dispensing assembly, said fuel level sensor being configured to signal to said electronic controller a value of the current level of fuel contained in a tank associated with said dispensing assembly.

8. The system for controlling the dispensing of fuel or the like in a vending apparatus according to claim 1, wherein said mobile processing devices further comprise respective geolocation modules configured to obtain position data, which comprise geographical coordinates of said mobile devices, when said mobile devices communicate with said dispensing assemblies, said mobile devices being further configured to transmit said position data toward said central remote processing device.

9. The system for controlling the dispensing of fuel or the like in a vending apparatus according to claim 1, wherein said dispensing assemblies comprise local storage means which comprise a database adapted to store a list of said driver users that are registered and authorized at said dispensing assemblies.

10. The system for controlling the dispensing of fuel or the like in a vending apparatus according to claim 1, wherein said electronic controller and said short-range wireless communication module of said dispensing assembly are associated with said dispensing means of said dispensing assembly.

11. The system for controlling the dispensing of fuel or the like in a vending apparatus according to claim 10, wherein said electronic controller and said short-range wireless communication module of said dispensing assembly are associated with said electric pump of said dispensing means of said dispensing assembly.

12. The system for controlling the dispensing of fuel or the like in a vending apparatus according to claim 1, further comprising at least one managing and processing device operated by a respective user in charge, configured to allow said user in charge to interact with said remote central processing device, said at least one manager device being connected to and communicating with said central remote device via said telematic communication network.

13. The system for controlling the dispensing of fuel or the like in a vending apparatus according to claim 12, wherein said managing and processing device is configured to update the data stored in said local storage means of said dispensing assemblies, or in remote storage means of said central remote processing device.

14. The system for controlling the dispensing of fuel or the like in a vending apparatus according to claim 1, wherein said electronic controller of said dispensing assembly is configured to monitor a temperature of said electric pump of said dispensing means of said dispensing assembly, said temperature being detected by means of a temperature sensor connected to said electronic controller and arranged in contact with or proximately to said electric pump, an instantaneous value of said temperature being used by said electronic controller in order to assess said operating condition of said dispensing means of said dispensing assembly.

15. The system for controlling the dispensing of fuel or the like in a vending apparatus according to claim 14, wherein said operating condition for the control of said electric pump of said dispensing means, performed by said electronic controller, consists in the passing of at least one first temperature threshold of said electric pump;

upon the occurrence of said operating condition cited above, said electronic controller is configured to slow down said electric pump of said dispensing means.

16. The system for controlling the dispensing of fuel or the like in a vending apparatus according to claim 15, wherein said operating condition for the control of said electric pump of said dispensing means, performed by said electronic controller, consists in the passing of a second temperature threshold of said electric pump;

upon the occurrence of said operating condition cited above, said electronic controller is configured to stop said electric pump of said dispensing means.

17. The system for controlling the dispensing of fuel or the like in a vending apparatus according to claim 15, wherein said operating condition for the control of said electric pump of said dispensing means, performed by said electronic controller, consists in the passing of a threshold of consecutive operating time of said electric pump;

upon the occurrence of said operating condition, said electronic controller is configured to stop said electric pump of said dispensing means.

18. The system for controlling the dispensing of fuel or the like in a vending apparatus according to claim 1, wherein said dispensing assembly comprises authentication means adapted to authenticate said driver users, verifying the identity of said driver users.

19. The system for controlling the dispensing of fuel or the like in a vending apparatus according to claim 18, wherein said authentication means of said dispensing assembly comprise an iButton device reader adapted to detect and recognize an iButton device owned by each one of said driver users.

20. The system for controlling the dispensing of fuel or the like in a vending apparatus according to claim 19, wherein said authentication means of said dispensing assembly comprise a biometric parameter reader adapted to detect and recognize at least one biometric parameter for each one of said driver users.

21. The system for controlling the dispensing of fuel or the like in a vending apparatus according to claim 20, wherein said authentication means of said dispensing assembly comprise a reader of RFID, Radio-Frequency IDentification, tags which is adapted to detect and recognize an RFID tag owned by each one of said driver users.

22. The system for controlling the dispensing of fuel or the like in a vending apparatus according to claim 21, wherein said authentication means of said dispensing assembly comprise a reader of NFC, Near Field Communication, tags which is adapted to detect and recognize an NFC tag owned by each one of said driver users.

* * * * *